US007921742B2

(12) United States Patent
Kirby

(10) Patent No.: US 7,921,742 B2
(45) Date of Patent: Apr. 12, 2011

(54) MOUNTING AND SUSPENSION SYSTEM FOR SLIDING NON-CONTACT DISPLACEMENT AND SPEED MEASUREMENT

(76) Inventor: Richard Kirby, Heber City, UT (US)

( * ) Notice: Subject to any disclaimer, the term of this patent is extended or adjusted under 35 U.S.C. 154(b) by 528 days.

(21) Appl. No.: 12/030,873

(22) Filed: Feb. 14, 2008

(65) Prior Publication Data

US 2008/0190197 A1 Aug. 14, 2008

Related U.S. Application Data

(60) Provisional application No. 60/901,107, filed on Feb. 14, 2007.

(51) Int. Cl.
*A63C 11/00* (2006.01)
*G01P 1/00* (2006.01)

(52) U.S. Cl. ..... 73/866.5; 73/493; 73/526; 280/809

(58) Field of Classification Search ..... 73/170.16, 73/170.26, 493, 496, 526, 866.5; 280/809
See application file for complete search history.

(56) References Cited

U.S. PATENT DOCUMENTS

| | | | | |
|---|---|---|---|---|
| 4,136,451 | A | 1/1979 | Briand | |
| 4,860,585 | A | 8/1989 | Tuyn | |
| 4,864,860 | A | 9/1989 | Manseth | |
| 4,890,477 | A * | 1/1990 | Losev et al. | 73/9 |
| 6,216,536 | B1 | 4/2001 | Manseth | |
| 6,279,924 | B1 * | 8/2001 | Murphy et al. | 280/14.23 |
| 6,498,994 | B2 * | 12/2002 | Vock et al. | 702/44 |
| 2002/0036386 | A1 * | 3/2002 | Murphy et al. | 280/14.23 |
| 2004/0075737 | A1 | 4/2004 | Kirby | |
| 2005/0242594 | A1 * | 11/2005 | Arakawa | 292/327 |
| 2009/0032672 | A1 * | 2/2009 | Cooper et al. | 73/866.5 X |

FOREIGN PATENT DOCUMENTS

DE 19524842 A1 * 1/1997

* cited by examiner

*Primary Examiner* — Thomas P Noland

(57) ABSTRACT

A mounting and suspension system for mounting non-contact sliding measurement devices to the side of objects that slide on snow or ice like skis, snowboards, sleds, luges, and ice skates. A base component permanently attached to the sliding object allows a quick disconnect of the rest of the device. A linkage component permits the retraction of the measurement device relative to the sliding object in such a way that the measurement device remains aligned with the surface being measured while minimizing lateral displacement and fully retracted vertical height such that accurate measurement is obtained at any angle of sliding object relative to the surface of snow or ice. A bias device keeps the measurement device in firm contact with the surface without interfering with the use of the sliding object. A safety device prevents injury to user and damage to measurement device in case of impact with an external obstacle or fall.

20 Claims, 7 Drawing Sheets

MOUNTING AND SUSPENSION SYSTEM FOR SLIDING NON-CONTACT DISPLACEMENT AND SPEED MEASUREMENT

CROSS-REFERENCE TO RELATED APPLICATIONS

This application claims the benefit of provisional patent application Ser. No. 60/901,107, filed Feb. 14, 2007.

FEDERALLY SPONSORED RESEARCH

Not applicable.

SEQUENCE LISTING OR PROGRAM

Not applicable.

BACKGROUND OF THE INVENTION

1. Field of Invention

This invention relates to devices which measure the displacement of an object sliding across a surface of snow or ice such as a ski, snowboard, sled, luge or ice skate.

2. Prior Art

Numerous methods have been proposed to measure the speed of a ski. Originally these methods used some form of mechanical contact measurement such as a wheel or roller which was attached to the tail of a ski via a spring loaded arm. U.S. Pat. No. 4,136,451 is such a device which consists of a wheel which rolls on the snow surface. The wheel is attached to a spring loaded arm which pivots about an axis which is perpendicular to the axis of the ski but in the plane of the ski. This allows the wheel to remain in contact with the snow if the tail of the ski rises up a certain amount.

U.S. Pat. No. 4,860,585 describes a similar device, also using a mechanical cog type roller to detect speed. This device is also attached to the tail of the ski via a pivot perpendicular to the axis of the ski. This device has the advantage that the roller extends the width of the ski which improves the contact to a certain extent when the ski is at lower edge angles.

U.S. Pat. No. 4,864,860 describes a device which uses a roller mounted to the tail of the ski to drive a generator. The generator is held against the snow by an arm which rotates about a pivot perpendicular to the axis of the ski like the two previously mentioned references.

U.S. Pat. No. 6,216,536 describes a similar device that pivots both about an axis perpendicular to the longitudinal axis of the ski in the plane of the ski as well as a second axis normal to the plane of the ski. By adding the second axis, the device is able to determine side slip behind the tail of the ski as well as forward speed under some circumstances.

The four aforementioned references share a number of disadvantages. First, the tail of a ski is a very unwieldy place to have something that rises above the surface of the ski. Ski tails are often crossed either unintentionally while skiing or intentionally when using the skating technique, which is very common when starting a run, making a turn at slower speeds, or crossing a flat section of a slope. Each of the above devices would prevent a skier from crossing the tails of the skis thus provoking a dangerous situation or preventing the skis from being used in one of the required modes of skiing.

In addition to being dangerous and limiting certain ski techniques the tail of a ski as a mounting location has another serious disadvantage as it is subject to very high vibration loads. Ski Rossignol has measured the vibration on the tail of a ski at up to 1000 g. With this type of force, it would be very hard to keep a tail-mounted device against the snow. If a spring strong enough to keep the device down were used, it would bend the tail of the ski up off the snow and interfere with the performance of the skis.

While the first three references have no means of measuring sideways slip (a very important characteristic of ski technique) U.S. Pat. No. 6,216,536 does have a pivot normal to the plane of the ski which allows the measurement of slippage under certain very constrained conditions. However, high edge angles (where most slip occurs), high vibrations (unavoidable on the tail of a ski), and the ski bent into an arc by carving the ski on its edge, would all prevent this device from accurately measuring slippage when mounted behind the tail of the ski. Additionally, locating the measurement device behind the tail of the ski distorts the measurement of slippage, as ski tails slide much more than the center or tip of the ski.

Another category of devices use non-contact means of determining speed. Most notably DE 195 24 842 talks of using Doppler technique, laser anemometer, or an optical signal correlation technique such as those provided by CORRESYS-DATRON Sensorsysteme GmBH and U.S. patent application Ser. No. 10/346,713 from this applicant uses optical navigation technology to optically determine the displacement of spatial patterns using spatial pattern recognition. Both of these references show embodiments where the non-contact means of determining speed is located inside the body of the ski. While both these references note that it is possible to mount the sensors somewhere other than inside the body of the ski, neither describe any mechanical apparatus for doing so.

Mounting a speed detection system inside a ski has a number of serious disadvantages, notably, the ski structure must be modified, which requires the skis to be built at the factory in such a way that they are enabled for the device. In addition, changing the inner structure of the ski changes the skis characteristics as well as it would require ski manufacturers to retool their assembly lines. Lastly, a device built into the ski, could not be used with existing skis, substantially reducing the size of the market.

OBJECTS AND ADVANTAGES

Accordingly, several objects and advantages of the present invention are:

(1) to provide a support for a displacement and speed measurement system for skiers that doesn't interfere with ski usage, especially skating.

(2) to provide a support for a displacement and speed measurement system which can be used on any existing ski without modification.

(3) to provide a support for a displacement and speed measurement system which does not affect the turning characteristics of the ski.

(4) to provide a support for a displacement and speed measurement system that protects the measurement components from the large shock and vibration loads that many parts of a ski are subjected to.

(5) to provide a support which keeps the displacement and speed measurement system aligned with the surface that is being measured in such a way that the measurements are accurate.

(6) to provide a support for a displacement and speed measurement system which prevents injury to skier by retracting when hit by enough force that might cause the skier to lose balance.

(7) to provide a support for a displacement and speed measurement system which prevents damage to the system in case of a fall or high force impact.

(8) to provide a support for a displacement and speed measurement system which does not distort slip measurements.

(9) to keep non-contact measurement devices aligned with the surface being measured even when the object that is sliding rolls on edge vs. the measurement plane by up to 90 degrees.

(10) to keep induced lateral slip less than 1 inch (2.54 cm) during edging of sliding object vs. measurement plane.

Further objects and advantages of my invention will become apparent from a consideration of the drawings and ensuing descriptions.

SUMMARY

In accordance with the present invention a mounting and suspension system for non-contact displacement and speed measurement comprising a linkage mechanism, and a device for biasing linkage mechanism such that displacement and speed measurement device follows surface being measured while remaining aligned with that surface.

DRAWINGS

Figures

In the drawings, closely related figures have the same number but different alphabetic suffixes.

FIG. 1 shows a perspective view of a ski with a binding, and a speed and displacement measurement device with mounting and suspension system. Quick-release is shown in open position. No guard device is shown.

Figure 4A:
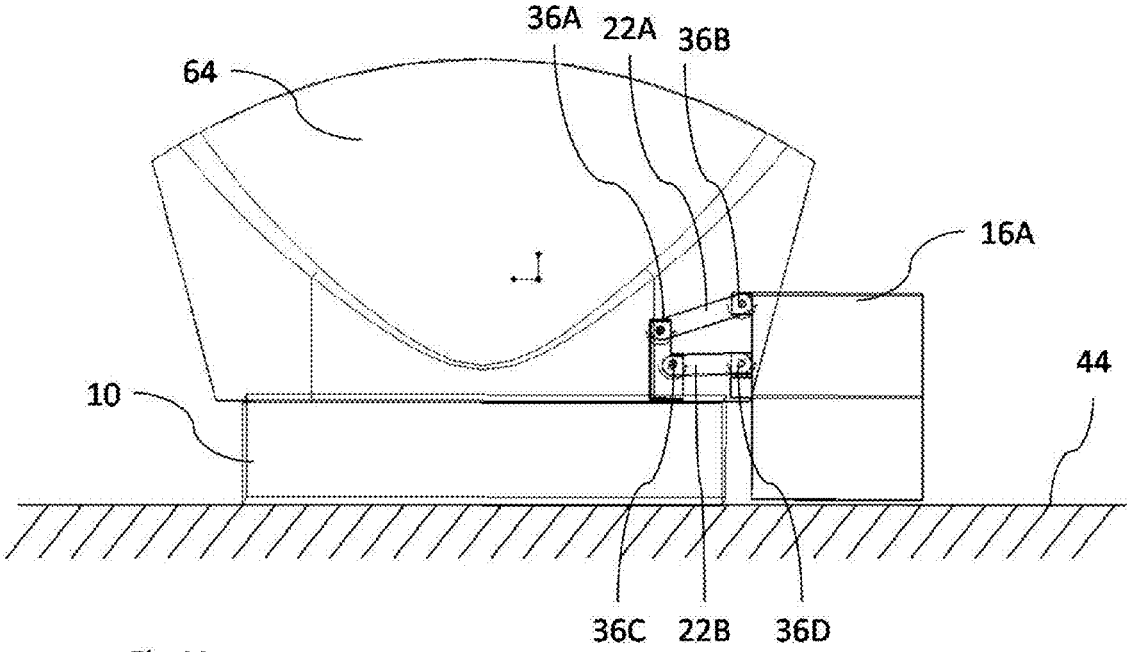

FIG. 4*a* shows an end view of the preferred embodiment of the suspension system with suspension fully deployed. Guard is shown.

Figure 4B:
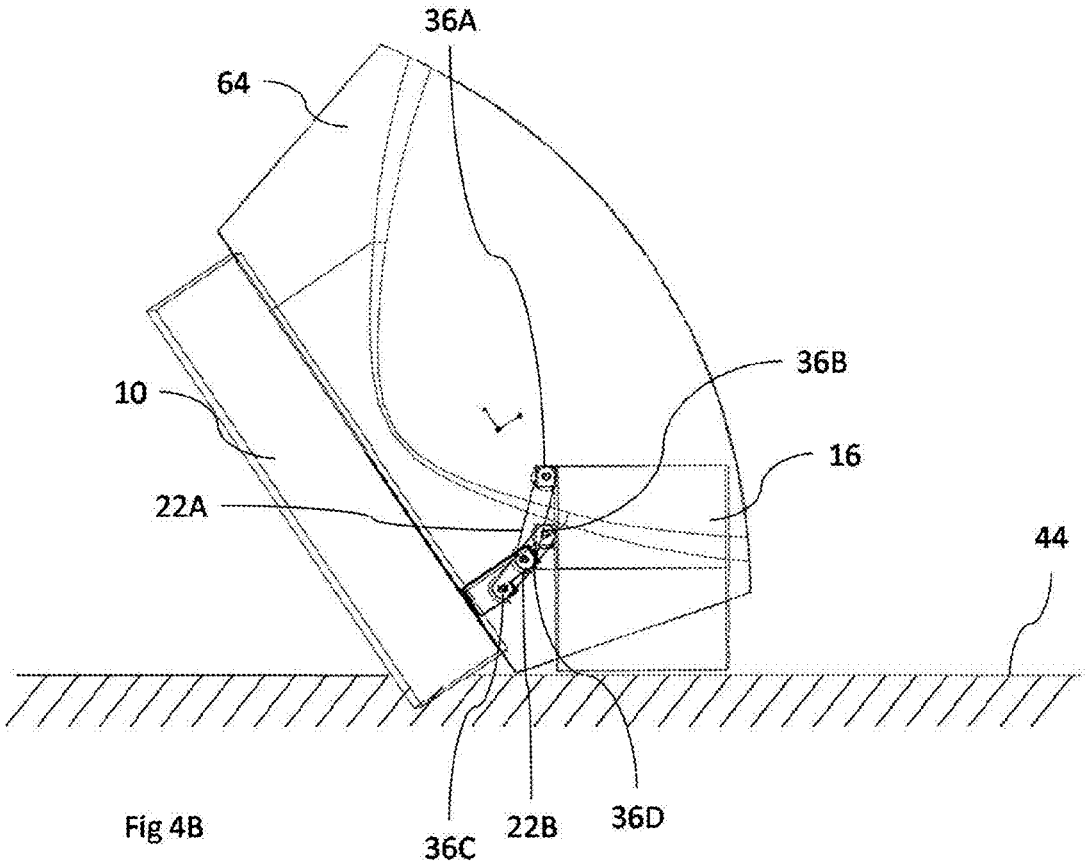

FIG. 4*b* shows an end view of the preferred embodiment of the suspension system with suspension partially compressed due to ski being on edge. Guard is shown.

Figure 5:
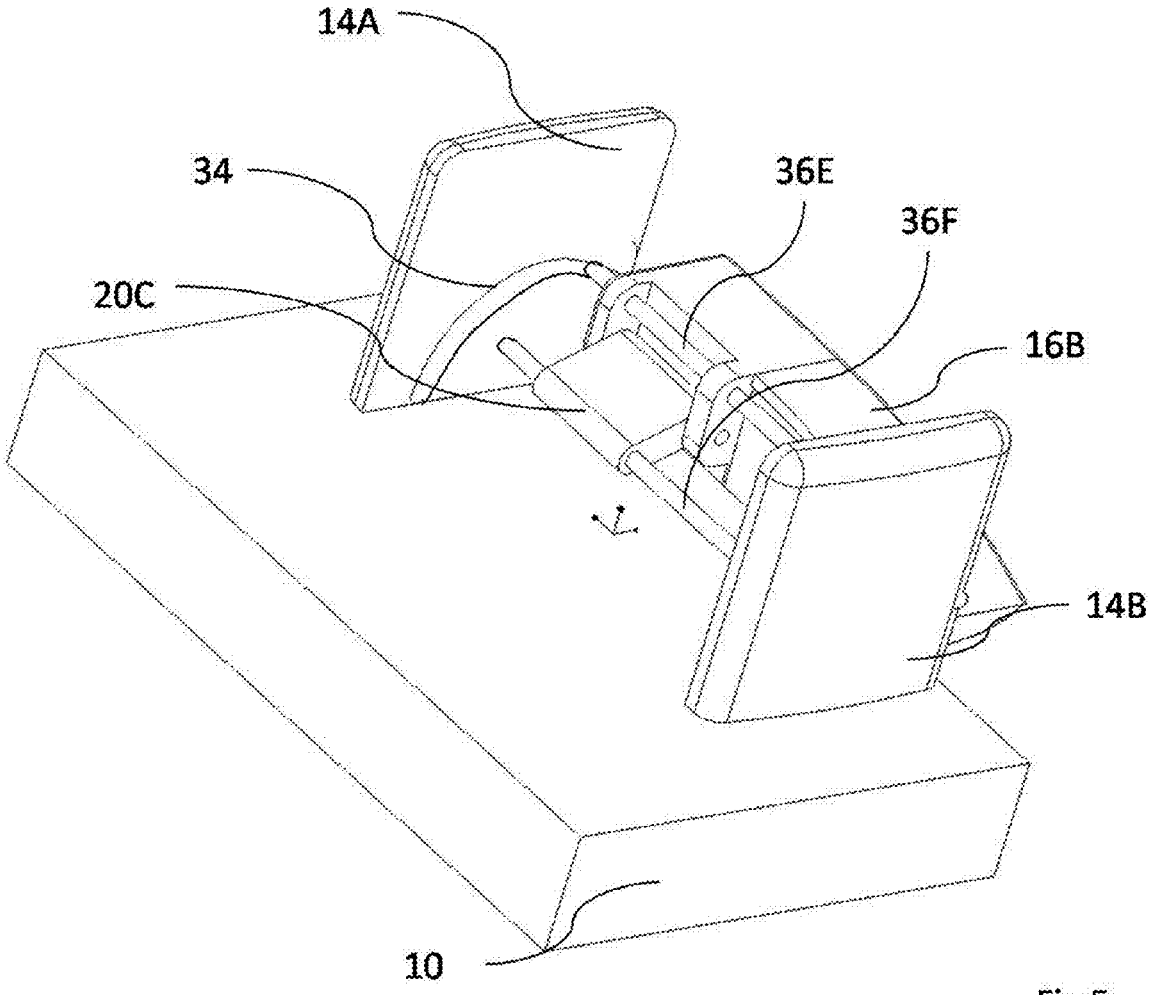

FIG. 5 shows a perspective view of an alternative embodiment.

Figure 6:
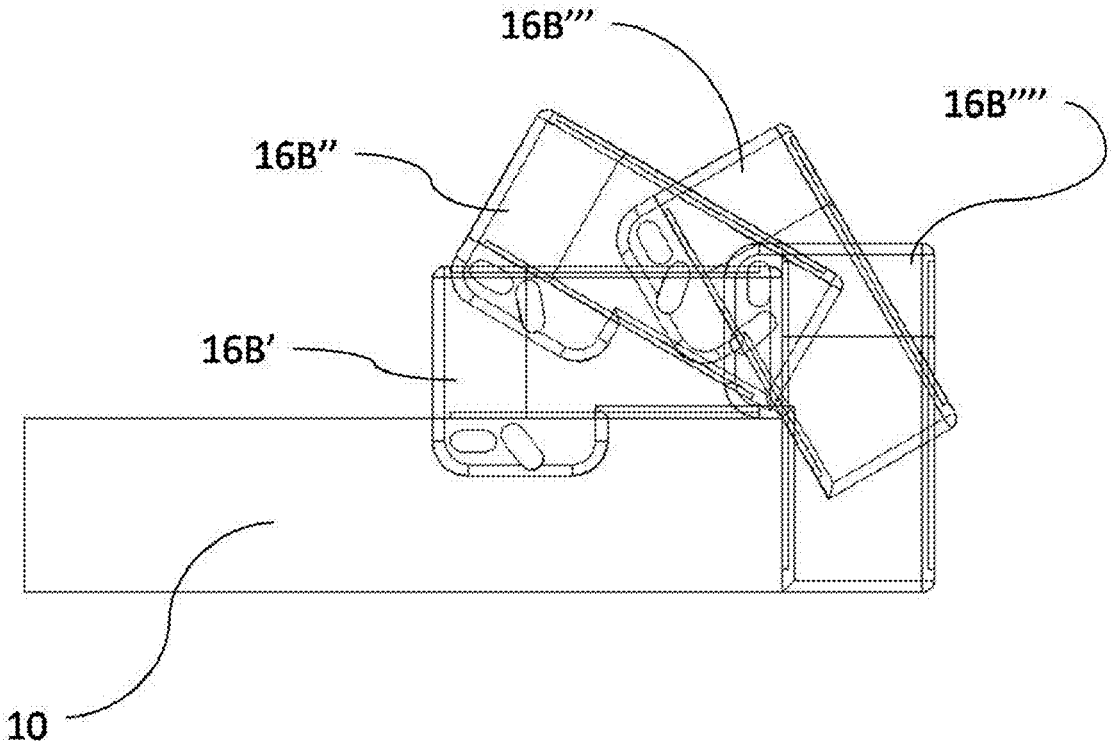

FIG. 6 shows the path of the speed and displacement system in the alternative embodiment as it retracts due to the ski being put on edge.

DRAWINGS

Reference Numerals

10 Ski
12 Binding
14 Cam Follower Bracket
16 Speed and Displacement Measurement Unit
18 Retraction Cable
20 Ski Brake
22 Linkage Arm
24 Quick-Release Cam Arm
26 Removable Mounting Bracket
28 Biasing Device
30 Base Plate
32 Receiver for a Quick-Release Device
34 Cam Groove
36 Axle Shaft
38 Adhesive
40 Alignment Key
42 Alignment Groove
44 Snow Surface
46 Cam Locking Groove
48 Quick-Release Shaft
50 Locking Pin
52 Fixed Mounting Plate Assembly
54 Removable Suspension and Measurement Assembly
56 Tension Adjustment Nut
58 Quick-Release Pivot Pin
60 Binding Plate
62 Vertical Compression Element
64 Guard

DETAILED DESCRIPTION

FIGS. 1 through 4

Preferred Embodiment

Figure 1:
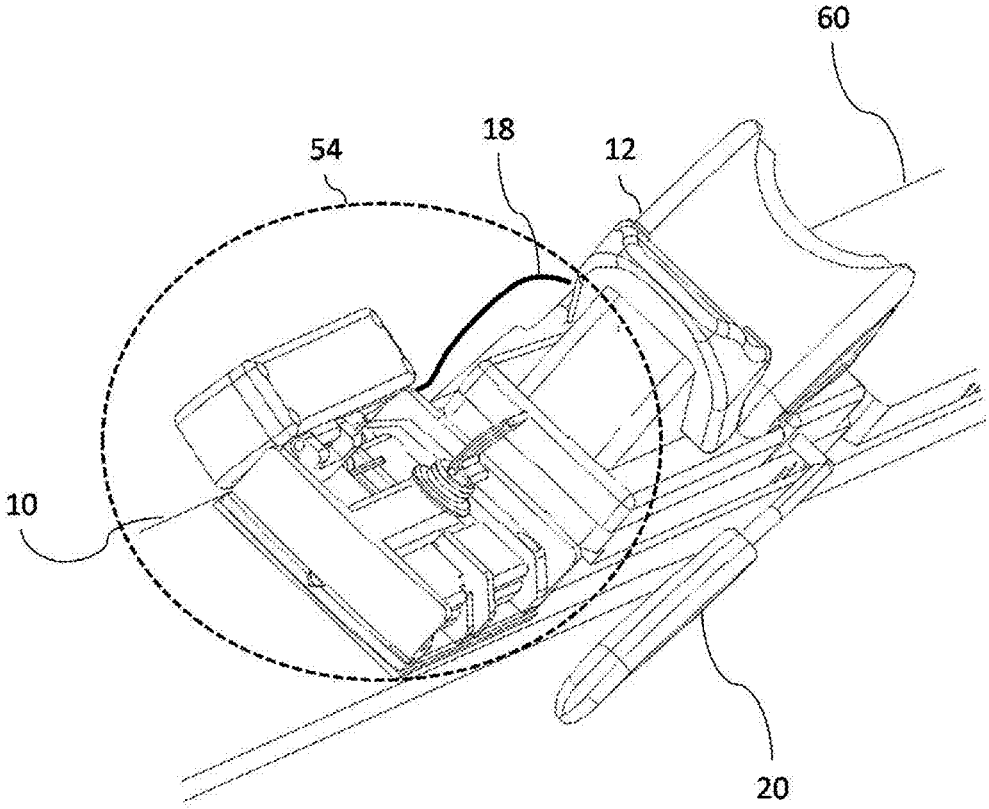
Figure 2:
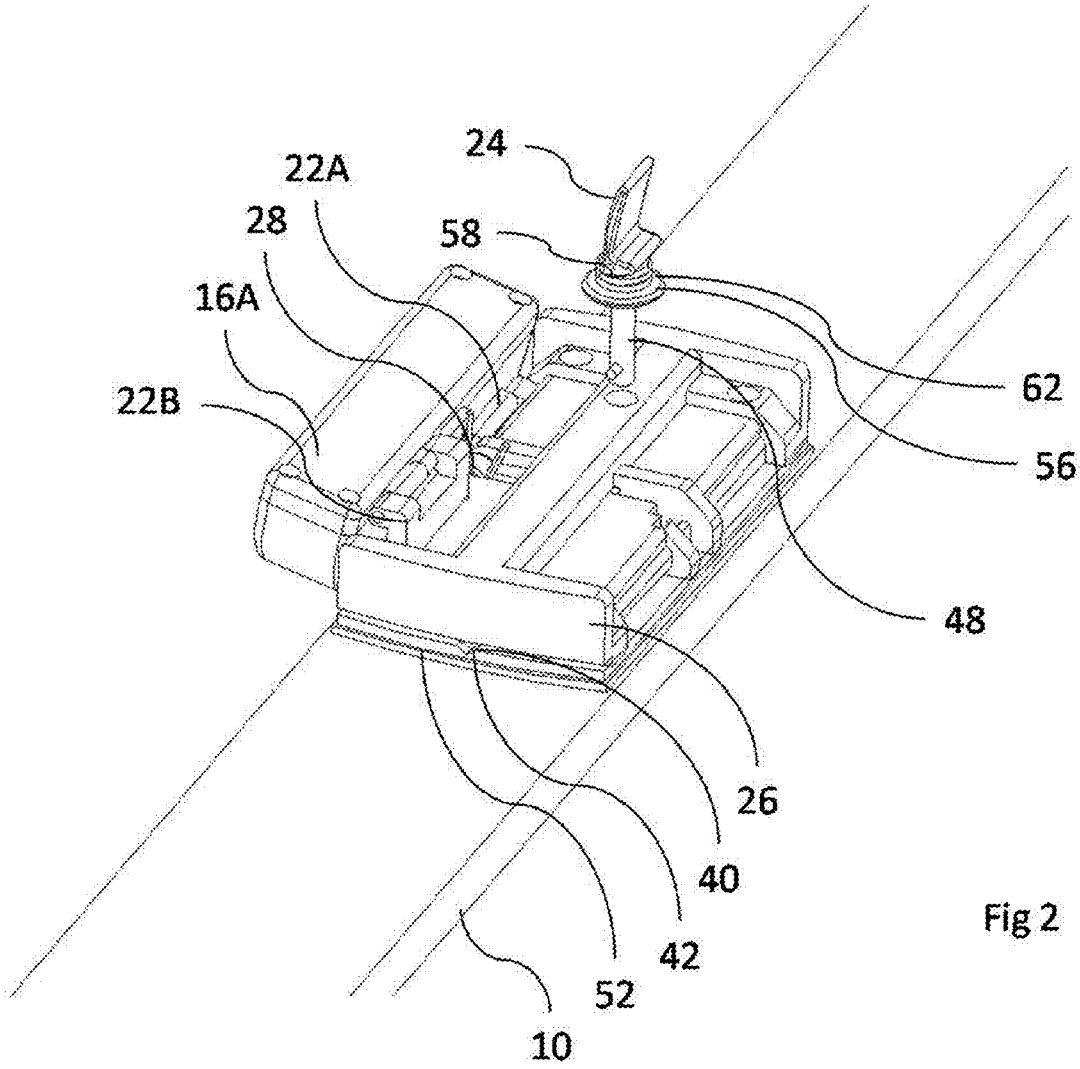
FIG. 2 shows a perspective view of the preferred embodiment of the mounting and suspension system. Quick-release device is shown exploded in the open position.

A preferred embodiment of the mounting and suspension system of the present invention is illustrated in FIGS. 1 through 4. FIG. 1 shows the relative position of the key components of the system. A removable suspension and measurement assembly (54) is attached to a fixed mounting plate assembly (52) shown in FIG. 3. The fixed mounting plate assembly (52) of FIG. 2 is in-turn attached to a ski (10) of FIG. 3 also having a binding (12), a ski brake (20), and a binding plate (60). The preferred attachment location is behind the binding (12) although one skilled in the art could easily conceive of alternative locations including in front of the binding or incorporated in the binding (12) or binding plate (60). In the preferred embodiment, a retraction cable (18) connects the ski brake (20) to a linkage arm (22A) of FIG. 2.

Figure 3:
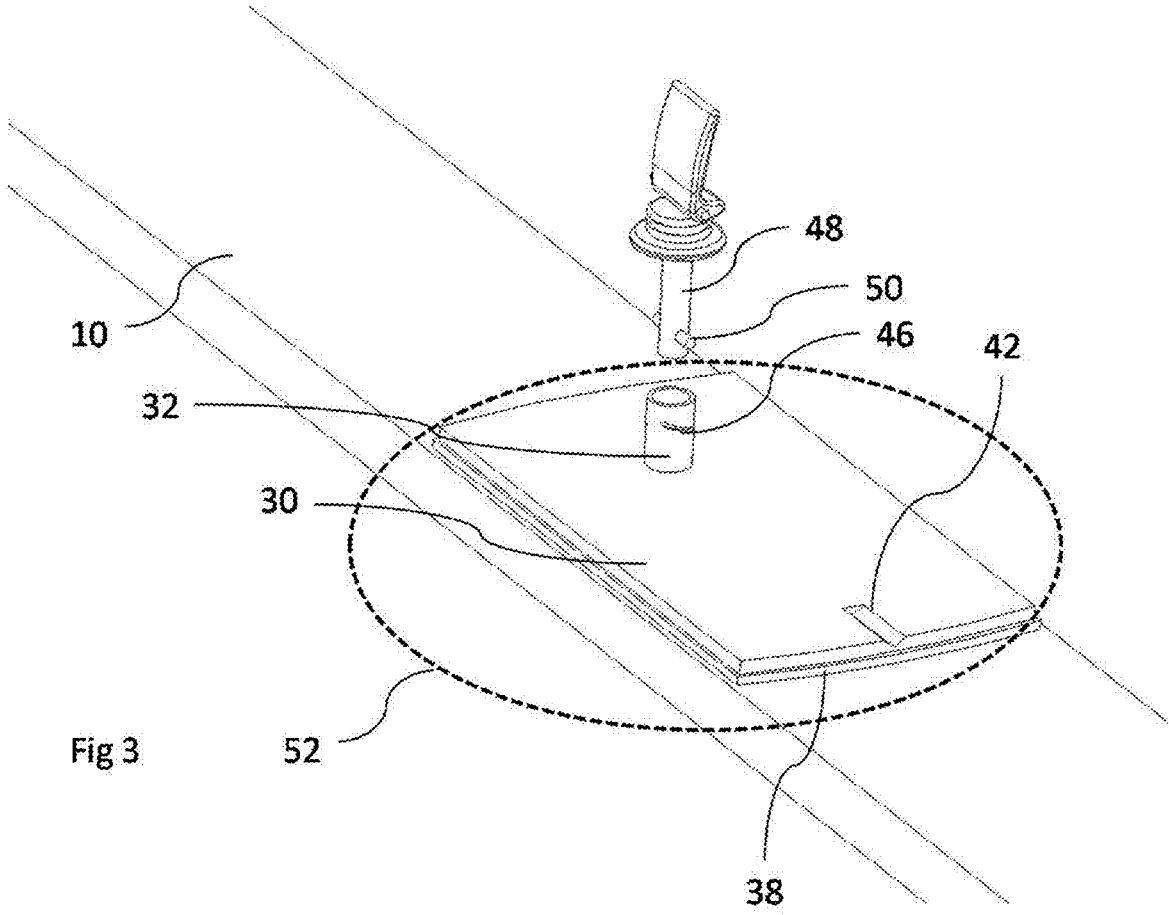
FIG. 3 shows a perspective view of a mounting plate with safety mechanism. Quick-release assembly is shown exploded in the open position.

In FIG. 3, a base plate (30) is attached to the ski (10) by means of an adhesive (38). In the preferred embodiment, the base plate (30) is made of molded plastic such as polycarbonate and the adhesive is a double sided tape. Other means of mounting (fasteners, hook and latch, or built into ski) could be conceived by one skilled in the art. The base plate (30) has a receiver for a quick-release device (32) integrated in the plate. The receiver (32) is of the ¼ turn type and has a cam locking groove (46) which mates with a locking pin (50) on a quick-release shaft (48). FIG. 3 shows the quick-release assembly in an exploded view for clarity. This assembly is located inside the suspension assembly (54) of FIG. 1. Any number of quick-release devices (latches, pins, buttons, etc.) could be conceived of by one skilled in the art. The base plate (30) of FIG. 3 also has an alignment groove (42) which when assembled fits into a mating alignment key (40) in a removable mounting bracket (26) of FIG. 2.

In FIG. 2, the removable mounting bracket (26) is attached to the ski (10) using the quick-release device. The quick-release device has a quick-release cam arm (24) attached to the quick-release shaft (48) via a quick-release pivot pin (58). Between the quick-release cam arm (24) and the surface of the removable mounting bracket (26) the quick-release shaft (48) has a vertical compression element (62) and is threaded for a tension adjustment nut (56). The vertical compression element could be the shaft of the quick-release shaft (48) itself, or a separate element such as a compression spring or an elastic substance. The quick-release shaft (48) also provides a pivot point normal to the plane of the ski (10) about which the removable mounting bracket (26) can rotate.

In FIG. 2, a speed and displacement measurement unit (16A) shown in a partially retracted position, is attached via two pivoting linkage arms (22A) and (22B). The measurement unit (16A) houses a means of non-contact speed or displacement measurement such as that using the Doppler technique, a laser anemometer, laser interferometer, optical signal correlation technique such as those provided by CORRESYS-DATRON Sensorsysteme GmBH, or optical navigation technology. In the preferred embodiment, the linkage between the measurement unit (16A) and the removable mounting bracket (26) consist of two unequal length arms (22A) and (22B) and four axle shafts (36A), (368), (36C), and (36D) shown in FIG. 4A and FIG. 4B. In the preferred embodiment, the axle shafts have a tight rotational fit within the arms providing frictional damping during linkage movement. The rotational axis for the arms (22A) and (22B) are parallel to the longitudinal axis of the ski, thus allowing the measurement unit (16A) to retract in such a manner that the measurement unit (16A) remains approximately aligned with, parallel to, a snow surface (44) shown in FIGS. 4A and 4B throughout the retraction process. The arms (22A) and (22B) acting as a linkage, keep the measurement unit oriented parallel to the surface during retraction and deployment of the measurement unit.

In FIG. 2, the measurement unit (16A) is biased against the surface (44) of FIG. 4 by means of a biasing device (28) which is a torsion spring in the preferred embodiment. One skilled in the art could conceive of numerous other types of biasing devices including but not limited to coil springs and leaf springs. In the preferred embodiment, the torsion spring is made of piano wire, but one skilled in the art could find numerous optional materials including plastics.

The removable mounting bracket (26) also has an alignment key (40) which mates with the alignment groove (42) in the base plate (30) shown in FIG. 3. In the preferred embodiment, the alignment key (40) has a triangular cross section which permits the mounting bracket (26) to rotate about the quick-release shaft (48) if the measurement unit (16A) experiences a high enough external load. The point at which the removable mounting bracket (26) rotates depends on the downward force of the quick-release cam arm (24) and the height and shape of the alignment key (40), the user being able to adjust the downward force of the quick-release cam arm (24) with the tension adjustment nut (56).

In the preferred embodiment, each ski contains a fixed mounting plate assembly (52) shown in FIGS. 2 and 3 and a removable suspension and measurement assembly (54) shown in FIG. 1. In the preferred embodiment, one of the removable suspension and measurement assemblies (54) has the measurement unit (16A) of FIG. 2 on the left side and the other has the measurement unit (16A) on the right side. Alternatively, each ski could have two measurement units (16A) one on each side of each ski (10).

The removable suspension and measurement assembly (54) of FIG. 1 can be fitted with a guard (64) shown in FIGS. 4A and 4B to add additional protection.

Operation—FIG. 2 T*hrough* 4

The operation of the mounting and suspension system consists of four elements, first the installation of the fixed mounting plate assembly (52) on the ski (10) shown in FIG. 1, second the installation and removal of the removable suspension and measurement assembly (54) from the fixed mounting plate assembly (52) of FIGS. 2 and 3, third, the operation of the suspension as the ski (10) tracks across a surface (44) of FIGS. 4A and 4B, and fourth the rotational safety feature of the quick-release device (24) and alignment key (40) and alignment groove (42) combination shown in FIG. 2.

Operation—Installation of Mounting Plate

In the preferred embodiment shown in FIG. 3, the mounting assembly (52) having the receiver (32) with cam locking groove (46) and the alignment groove (42) is adhered to the ski (10) in a semi-permanent manner using the adhesive (38). The preferred location is behind the binding (12) of FIG. 1.

In an alternative embodiment, the mounting plate could be installed in front of the binding, built into the binding (12) or binding plate (60) of FIG. 1. The alignment groove (42) is aligned with the centerline of the ski (10) to ensure that the measurement axis of the speed and displacement system (16) runs parallel to the longitudinal axis of the ski.

Operation—Installation and Removal of Removable Suspension Assembly

The suspension and measurement assembly (54) of FIG. 1 can be removed quickly to protect it during the transport of the skis, to be used on another pair of skis or with another skier, or to remove it to prevent theft while a skier is away from the skis. In the preferred embodiment, the quick-release shaft (48) of FIG. 2 is aligned with the receiver (32) of FIG. 3 while the removable suspension and measurement assembly (54) of FIG. 1 is lowered onto the fixed mounting plate assembly (52) previously installed on skis. Once the removable suspension and measurement assembly (54) has bottomed out against the fixed mounting plate assembly (52) the user rotates the suspension and measurement assembly (54) until the alignment key (40) falls into the alignment groove (42) at which time the user turns the quick-release cam arm (24) 90 degrees around its vertical (Z) axis, thus engaging the locking pin (50) on the quick-release shaft (48) into the cam locking groove (46) in the receiver (32) of FIG. 3.

The degree of vertical pressure exerted by the quick-release cam arm (24) can be adjusted using the tension adjustment nut (56). Once the desired tension is achieved, the user locks the quick-release cam arm (24) by moving it from the vertical position to the horizontal position, locking the assembly together via the cam pressure exerted by the cam arm (24) against bracket (26).

Operation—Suspension

As the ski (10) is turned, it is placed on edge relative to the surface (44) across which it is gliding as in FIG. 4B. The geometry of the linkage is selected such that the measurement unit (16A) remains aligned with the surface (44) in a manner that allows non-contact displacement and speed measurement devices to accurately collect data. Non-contact speed measurement devices such as those described earlier, produce better results if the alignment relative to the surface changes less than plus or minus 5 degrees throughout the range of possible edge angles which varies from 0 degrees to up to 65 degrees for expert skiers. In addition to controlling the alignment of the measurement unit (16A), the geometry of the linkage system also determines if the linkage system itself induces lateral movement of the speed and displacement system (16A) as the ski changes edge angle as well as the distance above the ski the retracted speed and measurement system (16A) extends. Induced lateral shift would result in an error in lateral displacement measurement. In the preferred embodiment, the first arm (22A) measures 13.46 mm from one rotational axis to the other and the second arm (22B) measures 7.10 mm from axis to axis. The distance between the axes on the measurement unit (16A) is 5.96 mm and on the removable mounting bracket (26) the distance between the axes is 3.58 mm. This geometry maintains alignment of better than plus and minus 5 degrees between the measurement unit (16A) and the surface (44) throughout the range of motion while minimizing both the lateral displacement as well as the height of measurement unit when measurement unit (16A) is fully retracted. One skilled in the art could devise other combinations of arms, arm lengths, linkages, and pivot points that would perform equally well as this configuration in maintaining alignment while minimizing both the lateral displacement and the fully retracted height.

In FIG. 2, the biasing device (28) which is a torsion spring in the preferred embodiment exerts pressure against the body of the measurement unit (16A) keeping the unit in contact with the snow surface (44).

The arms (22A) and (22B) produce rotational friction against the axle shafts (36A) through (36D) providing damping against vibration. This damping prevents the displacement measurement system from oscillating in situations where forces change rapidly, particularly when the measurement unit is on the high edge of the ski, when the skis leave the ground momentarily due to rough terrain, or skips sideways due to ruts in the skier's trajectory. It is in these types of situations that the skis experience the highest shock loads.

As skis or snowboards use the edges on both sides of the ski or snowboard to turn depending on whether one is executing a left or a right turn, the preferred embodiment has measurement units on each side. With a system on each side, one of the systems will be in sliding contact with the snow when the ski is in sliding contact with the snow. Unlike the prior art, which causes the measurement unit to move away from the snow surface during edging, my invention pushes the measurement unit against the snow during edging, substantially improving the quality of the measurement during edging.

Operation—Safety Systems

While the preferred embodiment positions the measurement unit (16A) on the inside of the skis, between the skier's legs, and behind the ski boot (which forms an effective shield as the ski boot extends off the ski on the inside approximately the width of the measurement unit (16A)), it may be possible for the measurement unit (16A) to come into contact with a fixed obstacle (such as a racing gate) that the skier straddles. To prevent damage to the measurement unit (16A) the entire removable suspension and measurement assembly (54) can rotate about the vertical axis of the quick-release shaft (48). This rotates the removable suspension and measurement assembly (54) onto the top of the ski (10) and away from harm.

As an external force on the measurement unit (16A) attempts to rotate the removable suspension and measurement assembly (54) the alignment key (40) attempts to slide up the ramp formed by the alignment groove (42). The downward force created by the quick-release arm (24), tension adjustment nut (56) and vertical compression element (62) prevent the alignment key from sliding up the ramp until the upward force created by the rotation torque against the alignment key (40) ramp exceeds the downward force of the vertical compression element (62). When this happens the alignment key frees itself from the alignment groove and the removable suspension and measurement assembly (54) is free to rotate to safety.

Added protection is afforded by the removable guard (64) shown in FIGS. 4A and 4B. This guard reduces the chance of damage to the displacement measurement system (16A) in a fall, but also if a skier accidently steps on the system while attempting to release the ski binding (12) by stepping on the release lever, usually on the back of the binding, with the boot of the other foot.

In addition to the above described safety mechanisms, added security can be obtained from a retraction system which is actuated by some external or triggering event. This triggering event is the deployment of the ski brake (20) of FIG. 1 in the preferred embodiment. This system consists of the retraction cable (18) that runs between the ski brake (20) and the linkage arm (22A) of FIG. 2. When the boot is in the binding (12) of FIG. 1 the ski brake (20) is rotated off the snow, and the retraction cable (18) is slack, allowing the measurement unit (16) of FIG. 2 to freely follow the snow surface (44) of FIG. 4. When the boot comes out of the binding (12) of FIG. 1 causing the ski brake (20) to deploy, the retraction cable is tensioned, pulling up on the linkage arm (22A) of FIG. 2 and fully retracting the measurement unit (16A) out of harms way.

Additional Embodiments

FIGS. 5 and 6 show an additional embodiment which has a single arm (20C) and two axle shafts (36E) and (36F) to form a linkage between the measurement unit (16B) and the ski (10). The first axle shaft (36F) is the pivot for arm (20) and the second axel shaft (36F) follows the cam groove (34) in two cam follower brackets (14A) and (14B) to guide the measurement unit in the desired path while maintaining the measurement unit substantially parallel to the surface. FIG. 6 shows the path of the measurement unit (16B) in four different retraction positions designated by (16B') through (16B"") demonstrating how the cam keeps the measurement unit substantially parallel to the surface and limits lateral displacement during retraction and deployment of the measurement unit.

One skilled in the art could conceive of numerous different linkages that would connect the measurement unit (16) to the removable mounting bracket (26) to precisely control the retraction path of the measurement unit.

Alternative Embodiments

While the preferred embodiment locates the system behind the binding for protection one skilled in the art could easily conceive of alternative locations including in front of the binding or incorporated in the binding (12) or binding plate (60). Incorporation in the binding (12) or plate (60) has the added advantage of providing built-in protection, but would be particular to a particular manufacturer's bindings or plates.

While the preferred embodiment consists of two measurement units one on the inside of each ski, each attached to an independent mounting and suspension system, it is also conceivable that to use a single measurement unit, two measurement units on one ski only, two measurement units one on the outside of each ski, or four measurement units, two on each ski.

While triggering a safety retraction cable (18) of FIG. 1 from the movement of the ski brake (20) is convenient, the retraction mechanism could be triggered by numerous other invents including high shock load detected by an accelerometer.

While attaching the fixed mounting plate with doubled sided tape is convenient and would work with the majority of skis, there are numerous other ways this could be done including the elimination of the mounting plate altogether (attaching the suspension and measurement assembly directly to the ski (10), using any known means of fastening (screws, hook and latch fastener, magnets, etc.) or incorporating the receiver for a quick-release device directly into the ski (10), binding (12), or binding plate (60).

While a quarter turn quick-release mechanism provides fast installation and reliable engagement, other quick-release schemes could be used including snaps, engaging buttons, pins, interlocking hooks, etc, which would be readily apparent to one skilled in the art. It is also conceivable that a quick-release mechanism would not be used.

Using the quick-release as a component of the safety system reduces components, but numerous other safety systems could be conceived by one skilled in the art that would allow the measurement unit to move out of harm's way when exposed to excessive loads. This could include a break-away system or even an active motorized system that detects shock loads electronically and withdraws the measurement unit to safety when predefined thresholds are exceeded.

One skilled in the art could conceive of numerous other systems for linking, biasing and damping. The simplest system would consist of a single arm biased by gravity without any damping. The linkage could consist of one or more arms, and arms may pivot or follow complex paths defined by more complex constraint systems. Biasing could be a simple torsions spring, a leaf spring, a coil spring or even a cantilevered beam that has enough flexibility to act as a spring. Damping could be performed through mechanical friction, fluid damping, elastomeric damping or any other method readily available to one skilled in the art.

Advantages

From the descriptions above, a number of advantages of this inventor's mounting and suspension system become evident:

(1) The system of the present invention does not interfere with the performance of the ski by adding height to the ski tail, thus allowing skating and eliminating skier falls due to inadvertently crossing the ski tails and having them hook together.

(2) The system of the present invention can be used to install a non-contact measurement unit to existing skis thus avoiding the need for specialty skis or special modifications to the skis that could degrade their performance.

(3) The system of the present invention has no impact on the performance of the skis thus avoiding danger to the skier and allowing high performance skiers or racers to ski and train with a measurement unit while executing precise technical movements.

(4) The system of the present invention, by allowing the speed and displacement measurement portion of the system to be located near the center of the ski, significantly reduces the exposure to the high shock loads (up to 1000 g) experienced near the extremities of the skis to a much more sustainable load of 10 g experienced at the bindings.

(5) The system of the present invention provides a linkage that keeps the displacement and speed measurement system aligned with the surface that is being measured thus improving the accuracy and performance of non-contact speed and displacement sensor technologies.

(6) The system of the present invention retracts the displacement and speed measurement component when hitting an external obstacle such that the skier may avoid injury and the device avoids damage.

(7) The system of the present invention retracts the displacement and speed measurement component when the ski releases which prevents damage to the system in a hard fall.

(8) The system of the present invention locates the measurement component of the system close to a neutral location on the ski for accurately measuring sideways displacement.

(9) The system of the present invention keeps non-contact measurement devices aligned with the surface being measured even when the object that is sliding rolls on edge vs. the measurement plane by up to 90 degrees.

(10) The system of the present invention keeps induced lateral slip to less than 1 inch (2.54 cm) during edging of sliding object vs. measurement plane.

Although the description above contains many specificities, these should not be construed as limiting the scope of the invention but as merely providing illustrations of some of the presently preferred embodiments of this invention. It will be apparent to one skilled in the art that the invention may be embodied still otherwise without departing from the spirit and scope of the invention.

While the embodiments described above show the invention being used on an alpine ski, this invention would be equally adaptable to a snowboard, cross-country ski, or the runners on a sled or luge, or even an ice skate.

CONCLUSION, RAMIFICATIONS, AND SCOPE

Accordingly, the reader will see that the mounting and suspension system for sliding displacement measurement devices of this invention can be used to attach a sliding measurement device to an object which slides on snow or ice in such a way that prevents changing the characteristics of the sliding object, eliminates the need to modify the sliding object, reduces shock loads on measurement device to sustainable levels, correctly aligns the measurement device through the range of motion of the sliding object, prevents damage in case of fall or collision by retracting and/or rotating out of the way, and minimizes induced slip. Furthermore, the mounting and suspension system has the additional advantages in that The geometry of the suspension can be configured to match the alignment requirements of all known non-contact measurement devices.

The spring constant and damping components could be selected to precisely match the shock and vibration modes that a particular sliding object experiences.

The mounting and suspension system could be partially or entirely incorporated into the ski, binding, plate, or skier's boot.

The measurement unit can be made in nearly any shape and any color to provide variety.

The suspension system can be fully enclosed by an aesthetic housing to appeal to different types of users.

The scope of the invention should be determined by the appended claims and their legal equivalents rather than by the examples given.

What is claimed is:

1. A system for mounting and suspending a sliding non-contact measurement device for an object sliding on a surface of snow or ice comprising:

(a) a linkage device to connect said non-contact measurement device to said object sliding on a surface of snow or ice;

(b) said linkage device comprising a parallel surface alignment device for maintaining a substantially parallel alignment between said sliding non-contact measurement device and said surface of snow or ice while said non-contact measurement device retracts and deploys in response to the changing of the orientation between said object sliding on a surface of snow or ice and said surface of snow or ice;

(c) a bias device to bias said sliding non-contact measurement device against said surface of snow or ice.

2. The system of claim 1 further comprising a damping device.

3. The system of claim 1 further comprising a quick-release device for allowing a portion of said system for mounting and suspending a sliding non-contact measurement device to be removed from said object sliding on a surface of snow or ice.

4. The system of claim 1 further comprising a safety device which permits the retracting of said non-contact measurement device in case of high shock loads.

5. The system of claim 1 further comprising a safety device which permits the retracting of said non-contact measurement device via a triggering event.

6. The system of claim 1 wherein said parallel surface alignment device further comprises a lateral displacement limiting device to limit the induced lateral displacement of said non-contact measurement device while said non-contact measurement device retracts and deploys in response to the changing of the orientation between said object sliding on a surface of snow or ice and said surface of snow or ice.

7. The system of claim 1 wherein said linkage device comprises a plurality of pivot points.

8. The system of claim 1 where said bias device is a torsion spring.

9. The system of claim 1 wherein said parallel surface alignment device comprises a plurality of unequal length arms.

10. The system of claim 1 wherein said parallel surface alignment device comprises a cam mechanism.

11. A system for mounting and suspending a sliding non-contact measurement device for an object sliding on a surface of snow or ice comprising:

(a) a linkage means for connecting said non-contact measurement device to said object sliding on a surface of snow or ice;

(b) said linkage means comprising an orientation alignment means for aligning said sliding non-contact measurement device to be substantially parallel with said surface of snow or ice while said non-contact measurement device retracts and deploys in response to the changing of the orientation between said object sliding on a surface of snow or ice and said surface of snow or ice;

(c) a bias device to bias said sliding non-contact measurement device against said surface of snow or ice.

12. The system of claim 11 further comprising a damping means to reduce oscillation.

13. The system of claim 11 further comprising a quick-release device for allowing a portion of said system for mounting and suspending a sliding non-contact measurement device to be removed from said object sliding on a surface of snow or ice.

14. The system of claim 11 wherein said orientation alignment means comprises a plurality of unequal length arms.

15. The system of claim 11 wherein said orientation alignment means comprises a cam mechanism.

16. The system of claim 11 wherein said orientation alignment means further comprises a lateral displacement limiting means to limit the induced lateral displacement of said non-contact measurement device while said non-contact measurement device retracts and deploys in response to the changing of the orientation between said object sliding on a surface of snow or ice and said surface of snow or ice.

17. The system of claim 11 where said bias device is a torsion spring.

18. A method for mounting and suspending a sliding non-contact measurement device for an object sliding on a surface of snow or ice comprising:

(a) linking said non-contact measurement device to said object sliding on a surface of snow or ice;

(b) aligning said sliding non-contact measurement device to be substantially parallel with said surface of snow or ice while said non-contact measurement device retracts and deploys in response to the changing of the orientation between said object sliding on a surface of snow or ice and said surface of snow or ice;

(c) biasing said sliding non-contact measurement device against said surface of snow or ice.

19. The method of claim 18 further providing the step of damping the movement of said non-contact measurement device.

20. The method of claim 18 further providing the step of limiting induced lateral displacement of said non-contact measurement device while said non-contact measurement device retracts and deploys in response to the changing of the orientation between said object sliding on a surface of snow or ice and said surface of snow or ice.

* * * * *